United States Patent [19]

Ogle

[11] 4,259,956

[45] Apr. 7, 1981

[54] CERTI-SEAL

[75] Inventor: Robert W. Ogle, Newport Beach, Calif.

[73] Assignee: IMS Limited, South El Monte, Calif.

[21] Appl. No.: 725,185

[22] Filed: Sep. 21, 1976

Related U.S. Application Data

[63] Continuation of Ser. No. 239,225, Mar. 29, 1972, abandoned, which is a continuation of Ser. No. 44,511, Jun. 8, 1970, abandoned.

[51] Int. Cl.[2] ..... A61J 1/06

[52] U.S. Cl. ..... 128/272

[58] Field of Search ..... 128/272, 285; 141/18, 141/21, 25-27, 329, 330, 357; 215/355, 200; 222/80, 320

[56] References Cited

U.S. PATENT DOCUMENTS

| | | | |
|---|---|---|---|
| 2,604,095 | 7/1952 | Brody | 128/272 X |
| 2,794,437 | 6/1957 | Tash | 128/272 |
| 2,860,635 | 11/1958 | Wilburn | 128/218 S |
| 2,925,100 | 2/1960 | Senger | 141/27 |
| 3,321,098 | 5/1967 | Ogle | 128/272 X |
| 3,376,866 | 5/1968 | Ogle | 128/272 X |
| 3,416,657 | 12/1968 | Sorenson, Jr. et al. | 128/272 X |

*Primary Examiner*—Christopher K. Moore
*Attorney, Agent, or Firm*—Joseph E. Mueth

[57] ABSTRACT

This patent describes a novel medicament package particularly adapted for the containment of liquid medication comprising a shell vial having cylindrical walls and an open end and a closed end, within said vial an inwardly extending annular shoulder integral with said cylindrical walls of said vial, said shoulder forming an annular indentation on the exterior of the wall of said vial, said cylindrical walls extending from said shoulder to said open and closed end, said shoulder being in proximity to the open end of said vial, an imperforate resilient stopper sealing the closed end of said vial, the peripheral portion of that side of the stopper facing the open end of the vial forming a seal on the inner surface of said shoulder to prevent the outward movement of said stopper within said vial under the influence of the vapor pressure of said liquid medication, said stopper being adapted to reciprocate in a piston-like fashion to the closed end of said vial to expel the contents thereof through a hollow needle when said stopper has been punctured by said needle.

2 Claims, 3 Drawing Figures

CERTI-SEAL

This is a continuation of application Ser. No. 239,225 filed Mar. 29, 1972 now abandoned, which was a continuation of Ser. No. 44,511 filed June 8, 1970 now abandoned.

BACKGROUND OF THE INVENTION

At the present time, volatile medication such as sodium bicarbonate is not pre-packaged in syringes since under some storage conditions, carbon dioxide might be evolved from the solution and leak from the syringe. Any such leakage would, of course, alter the chemical composition of the solution which is quite critical and must be within the range pH 7.5 to 8.0 at the time of administration. This pH range represents a solution which is supersaturated with carbon dioxide at atmospheric pressure. The commercially available sodium bicarbonate solution for medical use are packaged in several different ways. In one way, the sodium bicarbonate solution is sealed in a glass ampule at the time of manufacture. The ampule maintains the solution under its own vapor pressure so that the composition of the solution remains constant. However, at the time of use, the nurse or technician opens the ampule by sawing off the neck of the ampule with a file. The contents of the ampule is then drawn into a hypodermic syringe which is used for injection of the solution into the patient, or transfered to a bottle for intravenous administration. The opening of the ampule to the atmosphere permits the escape of carbon dioxide just prior to use, and hence there is no assurance that the injected medication is of the proper pH. Another package comprises a vial having a non-reciprocating rubber stopper at its open end. The rubber stopper is held in place by an overlying crimped metal seal. The contents of the vial are withdrawn for use by tearing away the metal seal, and aspirating the contents of the vial into a syringe. This procedure requires the injection of air into the vial to displace the medication being withdrawn, and thereby permits the loss of carbon dioxide to the vapor or air introduced into the vial in the transfer operation.

As those skilled in the art know, sodium bicarbonate solution is a life-saving drug used primarily to avoid acidosis in the case of cardiac arrest. The use of the drug normally occurs in emergency conditions which call for a rather precise pH range. It can be seen that the available packages do not meet these critical requirements and are also cumbersome and time consuming in use. The present invention is addressed to the solution of this longstanding problem in the art. It is believed that the novel package of this invention which provides for a closed system of transfer will increase the effectiveness of sodium bicarbonate solutions under emergency conditions, and will receive ready acceptance in hospitals.

SUMMARY OF THE INVENTION

Briefly, the present invention comprises a novel medicament package particularly adapted for the containment of liquid medication comprising a shell vial having cylindrical walls and an open end and a closed end, within said vial an inwardly extending annular shoulder integral with said cylindrical walls of said vial, said shoulder forming an annular indentation on the exterior of the wall of said vial, said cylindrical walls extending from said shoulder to said open and said closed end, said shoulder being in proximity to the open end of said vial, an imperforate resilient stopper sealing the closed end of said vial, the peripheral portion of that side of the stopper facing the open end of the vial forming a seal on the inner surface of said shoulder to prevent the outward movement of said stopper within said vial under the influence of the vapor pressure of said liquid medication, said stopper being adapted to reciprocate in a piston-like fashion to the closed end of said vial to expel the contents thereof through a hollow needle when said stopper has been punctured by said needle.

This invention further comprises as one preferred embodiment a novel injectable medication package for volatile medication comprising a vial and a syringe, said vial comprising a cylindrical, glass shell vial having an open end and a closed end, an inwardly extending annular shoulder integral with said vial and in proximity to the open end of said vial, an imperforate resilient stopper within said vial and sealing the closed end of said vial, the peripheral portion of that side of the stopper facing the open end of the vial forming a seal on the inner surface of said shoulder to prevent the outward movement of said stopper within said vial under the influence of the vapor pressure of said volatile medication, said syringe comprising a barrel having an open end and a closed end, a piston-type plunger received in said barrel, a needle extending from the closed end of said barrel, said needle and the closed end of said barrel being receivable in said vial whereby said needle punctures said stopper and the stopper can be reciprocated in a piston-like fashion to the closed end of said vial to transfer the contents of the vial through said needle to said barrel for subsequent administration.

It is an object of this invention to provide a novel package for volatile medication.

More particularly, it is an object of this invention to provide an improved package for aqueous sodium bicarbonate solutions.

Specifically, it is an object of my invention to furnish packaged aqueous sodium bicarbonate which is quicker and simple to use under the emergency conditions attendant cardiac arrest.

It is also inherent in this invention to provide annular indentation on the vial which is engageable by vial processing and filling equipment to facilitate lifting, support and movement of the vial.

These and other objects and advantages of this invention will be apparent from the following detailed description and the accompanying drawings.

DESCRIPTION OF THE PREFERRED EMBODIMENTS

Turning to the drawings.

Figure 1:
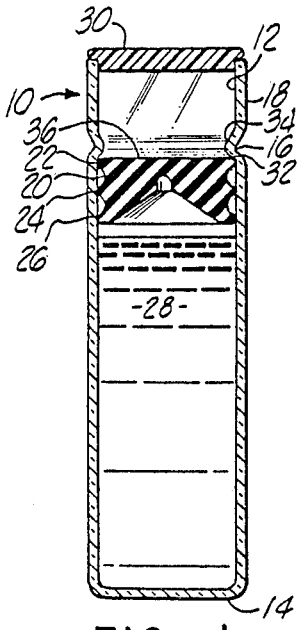
FIG. 1 is a sectional view of the novel vial and stopper of this invention with a volatile liquid medication present in the vial.

Turning to the drawings in greater detail, the glass shell vial 10 has an open end 12 and a closed end 14. The annular inwardly extending shoulder 16 is integral with the side wall 18 of the vial 10. The imperforate resilient stopper 20, normally made of rubber, is provided with sealing rings 22, 24 and 26. The number of sealing rings is not critical. Upper sealing ring 22 seals on shoulder 16. The sealing rings 22, 24 and 26 also seal on wall 18 by virtue of an interference fit of the rings with respect to the inside diameter of vial 10. However, the shoulder 16 provides a point of much greater interference with sealing rings 22, 24 and 26 so that the stopper 20 is restrained by the shoulder 16 from upward and outward movement within the vial under the vapor pressure of the liquid medication 28. During shipment and storage, vial 10 is provided with sealing cap 30. This cap is removed at the time of use.

Preferably, although not necessarily, the approach to shoulder 16 is sharper or more acute on the inward side 32 than on the outward side 34. In general, a sharp approach on the inward side forms a more effective seal and acts as efficient restraint for the stopper 20. The stopper 20 has an essentially flat outer surface 36. The vial of FIG. 1 can be used with either the syringe 38 of FIG. 2 or the intravenous solution bottle 40 of FIG. 3 to permit the injection of the medication 28 into the patient.

Figure 2:
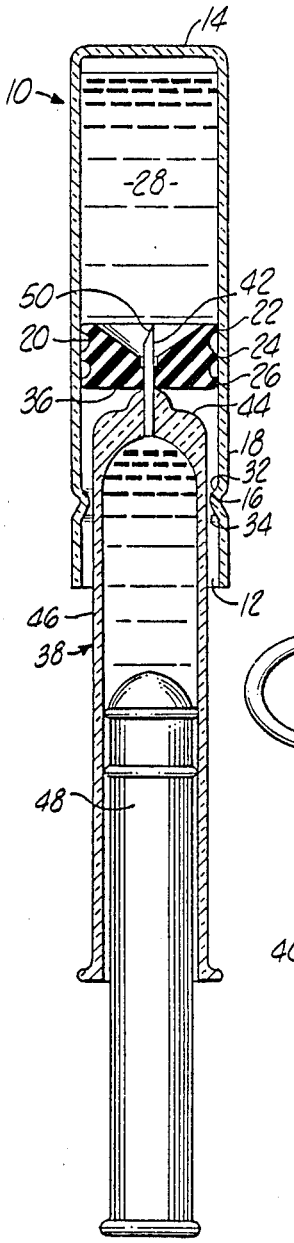
FIG. 2 shows in section the package of FIG. 1 in conjunction with a hypodermic syringe.

At the time of use, the vial 10 and syringe 38 are first arranged as shown in FIG. 2. The needle 42 extending from the closed end 44 of syringe barrel 46 is made to pierce stopper 20. The plunger 48 within the barrel 46 is then withdrawn, causing the medication 28 to be transferred to the syringe barrel. In the embodiment shown, the syringe barrel 46 has an external diameter less than the inside diameter of the vial at shoulder 16. This permits the barrel 46 to be received within the vial 10 so that essentially all of the medication 28 can be transferred to the syringe. After transfer has been accomplished, the end 50 of the needle 42 is inserted in the patient and the contents of the syringe expelled through needle 42 by the displacement of the plunger 48 into the barrel 46.

In manufacture, the liquid medication 28 is introduced into sterile vial 10 using conventional filling equipment. The stopper 20 is then forced past the shoulder 16 to form a seal therewith. The package can then be shipped and stored without loss of liquid or gases from the vial. My experience has shown that this package containing sodium bicarbonate can be stored at temperatures of over 140° F. for many weeks without any detectable change in pH.

Figure 3:
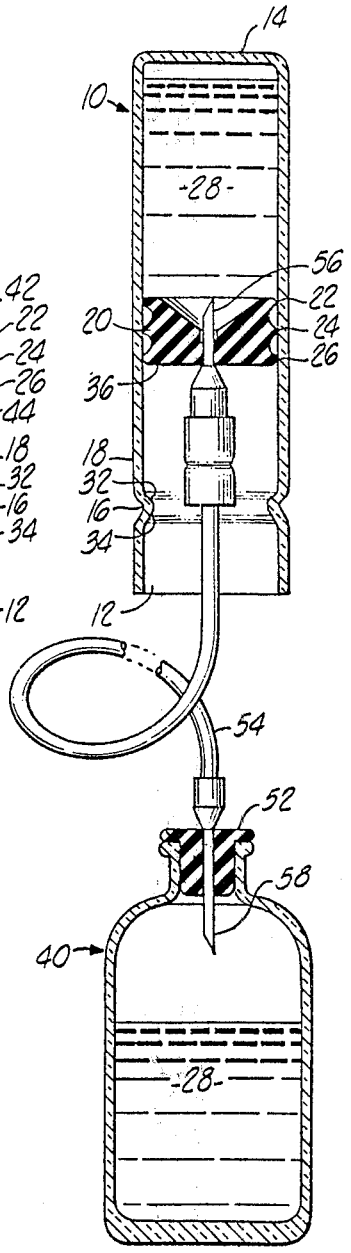
FIG. 3 shows a sectional view of another embodiment of this invention wherein the package is used with a vacuum bottle for subsequent intravenous administration.

Turning to FIG. 3 in detail, the bottle 40 is provided with a non-reciprocating plug 52. The bottle 40 is normally partially evacuated in the manner known to those familiar with intravenous solution bottles, and contains an intravenous solution.

According to this invention, a length of flexible tubing 54 fitted with a needle at each end is used to transfer the contents of vial 10 to bottle 40 prior to administration. The needle 56 is first inserted through stopper 20. The needle 58 is then used to pierce plug 52. The partial vacuum within bottle 40 draws the liquid medication 28 from the vial to the bottom, the stopper 20 reciprocating within vial 10 under the influence of the vacuum as shown in FIG. 3. After transfer has been completed, the solution in bottle 40 is used in conventional manner.

The package of this invention is particularly useful in the packaging and injection of aqueous sodium bicarbonate solution. However, it is useful in the packaging and injection of any volatile injection medication.

The shell vial is normally glass. However, the concept of this invention is not limited to any particular materials of construction.

The external annular indentation can be readily gripped in the pincers-like structure of vial processing equipment to provide for safer handling than is possible with vials having smooth straight-sided walls. The pincers are received in said indentation around the vial or at opposite sides of the vial. The indentation prevents sliding of the pincers on the vial during lifting and handling.

Having fully described the invention it is intended that it be limited only by the lawful scope of the appended claims.

I claim:

1. A novel medicament package containing an aqueous solution of sodium bicarbonate, such package comprising a shell vial having cylindrical walls and an open end and a closed end, within said vial an inwardly extending annular shoulder integral with said cylindrical walls of said vial, said shoulder forming an annular indentation on the exterior of the walls of said vial, the approach to said shoulder being sharper on the inward side than on the outward side of said shoulder, said cylindrical walls extending from the approach on the inward side of said shoulder to said closed end and from the approach on the outward side of said shoulder to said open end, said shoulder being in proximity to the open end of said vial, an imperforate resilient stopper sealing the open end of said vial, the side of the stopper facing the closed end of the vial being provided with a generally concave surface, the peripheral portion of that side of the stopper facing the open end of the vial forming a seal on the inner surface of said shoulder to prevent the outward movement of said stopper within said vial under the influence of the vapor pressure of said solution of sodium bicarbonate, said stopper being adapted to reciprocate in a piston-like fashion to the closed end of said vial to expel the contents thereof through a hollow needle when said stopper has been punctured by said needle.

2. The package of claim 1 wherein said imperforate resilient stopper is thinner at its center than at its periphery.

* * * * *